US007957677B2

(12) United States Patent
Miyata

(10) Patent No.: US 7,957,677 B2
(45) Date of Patent: Jun. 7, 2011

(54) DEVELOPING DEVICE AND IMAGE FORMING APPARATUS USING THE SAME

(75) Inventor: Hideaki Miyata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 794 days.

(21) Appl. No.: 11/481,961

(22) Filed: Jul. 7, 2006

(65) Prior Publication Data

US 2007/0147898 A1 Jun. 28, 2007

(30) Foreign Application Priority Data

Dec. 28, 2005 (JP) ..... P2005-380123

(51) Int. Cl.
*G03G 15/08* (2006.01)

(52) U.S. Cl. ..... 399/253; 399/359; 399/98

(58) Field of Classification Search ..... 399/253, 399/359, 98
See application file for complete search history.

(56) References Cited

U.S. PATENT DOCUMENTS 4,692,017 A * 9/1987 Maczuszenko et al. ..... 399/253
6,339,690 B1 * 1/2002 Karasawa ..... 399/253
6,466,758 B2 * 10/2002 Chigono et al. ..... 399/253
6,829,461 B2 * 12/2004 Arai et al. ..... 399/253
2008/0056770 A1 * 3/2008 Miyata et al. ..... 399/253

FOREIGN PATENT DOCUMENTS

JP 06186849 A * 7/1994
JP 10-186991 7/1998
JP 2001-22181 1/2001

OTHER PUBLICATIONS

English Machine Translation JP 06186849 A, published Jul. 1994.*
English Abstract JP 06186849 A, published Jul. 1994.*

* cited by examiner

*Primary Examiner* — David P Porta
*Assistant Examiner* — Bryan P Ready
(74) *Attorney, Agent, or Firm* — Morgan, Lewis & Bockius LLP

(57) ABSTRACT

A developing device that forms a toner image on an image carrier, including: a cleaning device that recovers a toner that remains on the image carrier; a recovered toner supply port to which a recovered toner is returned; a toner transporting section that transports the toner supplied from the recovered toner supply port within the developing device; a capturing section including a plurality of capturing members formed on a path along which the toner is transported by the toner transporting section, and capturing a foreign material; and a foreign-material removal member that moves along an elongating direction of the plurality of capturing members, and removes the foreign material captured by the plurality of capturing members.

21 Claims, 16 Drawing Sheets

DEVELOPING DEVICE AND IMAGE FORMING APPARATUS USING THE SAME

TECHNICAL FIELD

The present invention relates to an image forming apparatus that forms an image on a recording medium such as a recording sheet by using the electrophotographic system, such as a copier, a printer, a facsimile apparatus, or a composite apparatus of these apparatuses, and the like.

RELATED ART

An image forming apparatus using the electrophotographic system, such as a copier or a printer, is configured so that an electrostatic latent image formed on a photosensitive drum is developed by a developer (toner) in a developing device as a toner image, and the toner image formed on the photosensitive drum is transferred and fixed onto a recording medium. After the toner image is transferred onto the recording medium, toner remaining on the photosensitive drum is removed by a cleaning device and recovered.

When the toner which is recovered by the cleaning device is returned to the developing device to be reused, the toner which is recovered and returned to the developing device contains a foreign material such as paper dust from the recording sheet. A foreign material such as paper dust enters the toner in the developing device, and the amount of the entering foreign material increases over time. The foreign material that enters the toner adheres to the photosensitive drum, and causes an image failure. When its amount is increased, particularly, the possibility of causing an image failure is larger.

In the related art, however, a foreign material such as paper dust which enters a toner is fragmented, but not removed. Therefore, the fragmented foreign material is accumulated and causes an image failure. Furthermore, the configuration breaks paper dust aggregation into paper fibers, and the resulting paper fibers pass through the mesh member because they are thin. The thin paper fibers may easily cause an image failure.

SUMMARY

According to an aspect of the invention, there is provided a developing device that forms a toner image on an image carrier and includes: a cleaning device that recovers a toner that remains on the image carrier; a recovered toner supply port to which a recovered toner is returned; a toner transporting section that transports the toner supplied from the recovered toner supply port, within the developing device; a capturing section including a plurality of capturing members formed on a path along which the toner is transported by the toner transporting section, and capturing a foreign material; and a foreign-material removal member that moves along an elongating direction of the plurality of capturing members, and removes the foreign material captured by the plurality of capturing members.

BRIEF DESCRIPTION OF THE DRAWINGS

An exemplary embodiment of the present invention will be described in detail based on the following figures, wherein:

FIG. 11A is a section view, and FIG. 11B is a front view;

DETAILED DESCRIPTION

Hereinafter, an exemplary embodiment will be described with reference to the accompanying drawings.

Figure 1:
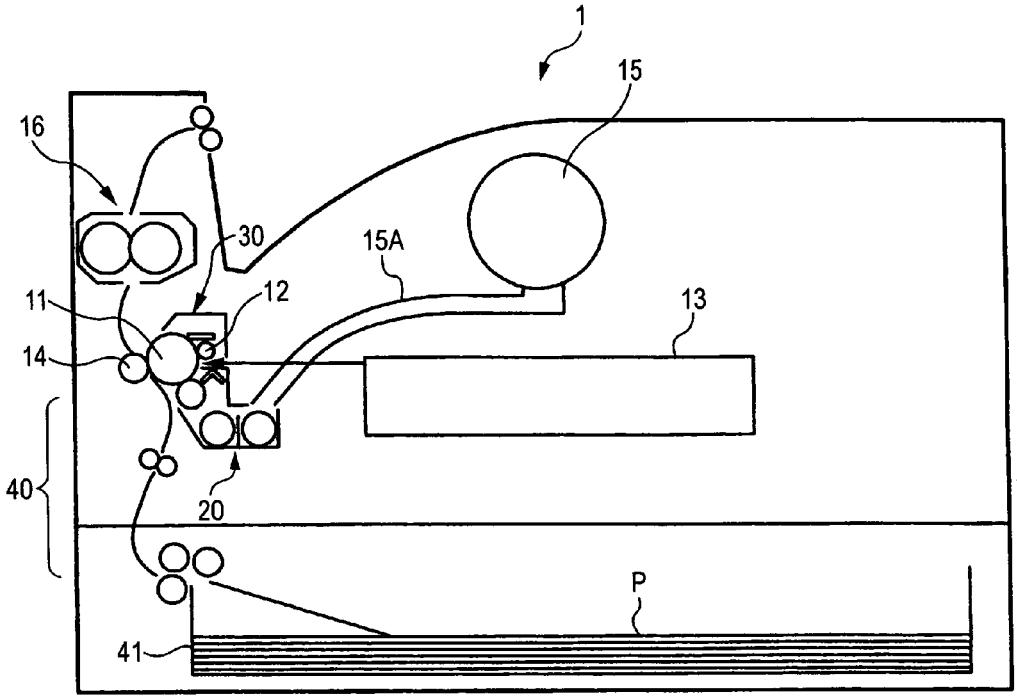
FIG. 1 is a diagram showing the whole configuration of an image forming apparatus of an exemplary embodiment, as viewed from an operation side.
Figure 2:
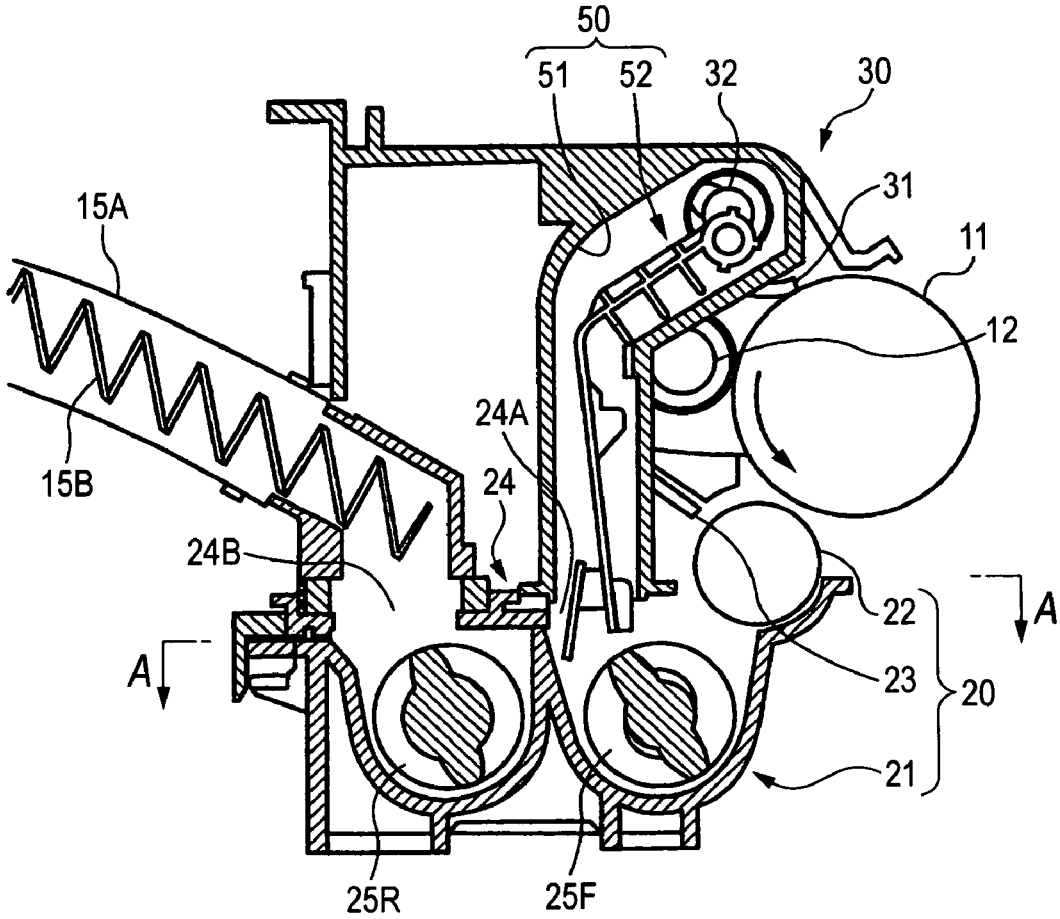
FIG. 2 is an enlarged section view of an image forming section, as viewed from the back side of the image forming apparatus.
Figure 3:
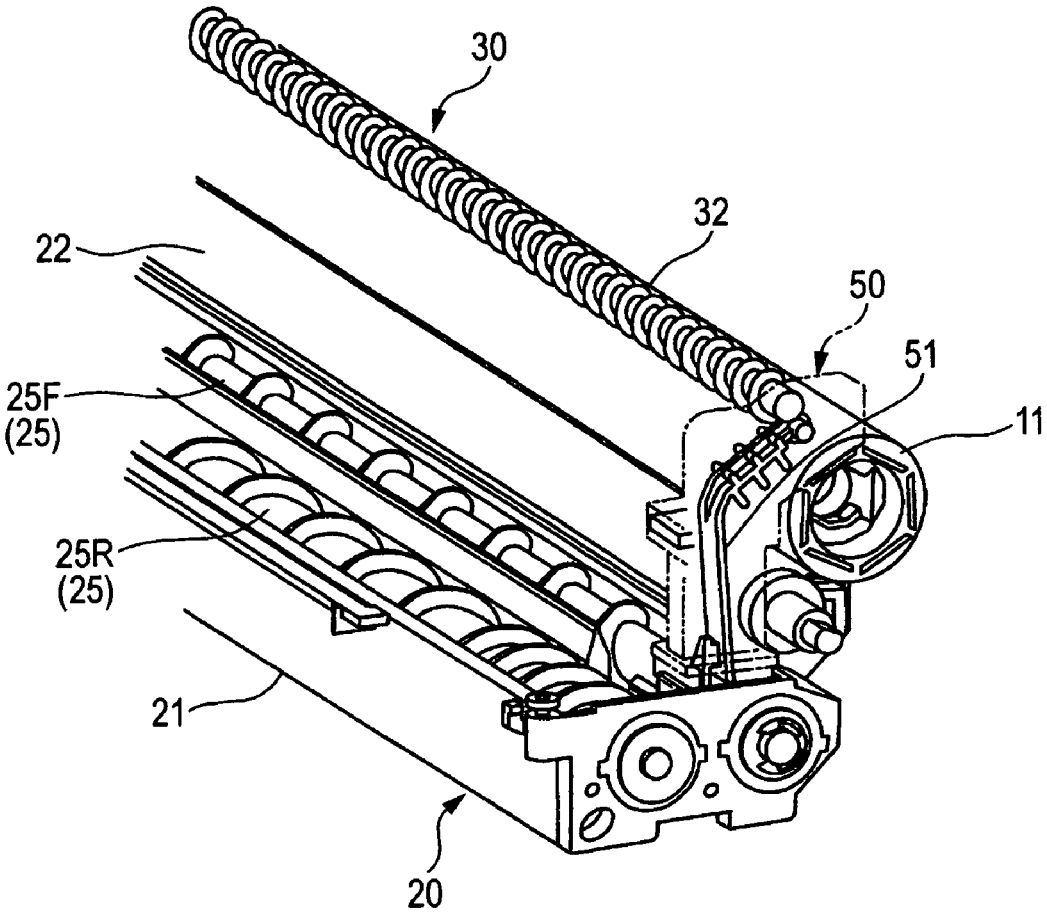
FIG. 3 is a perspective view illustrating a recovered-toner transporting mechanism, as viewed from the back side of the apparatus.
Figure 4:
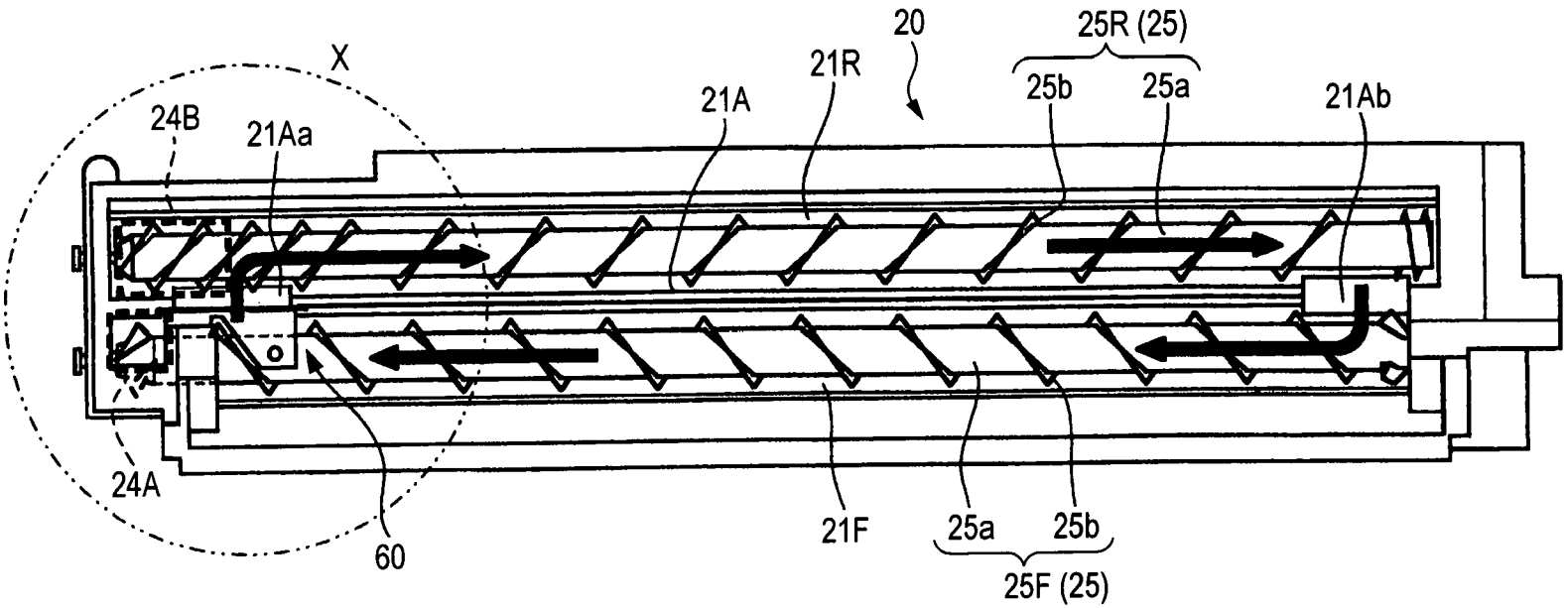
FIG. 4 is a plan view of a toner housing portion of a developing device corresponding to a section taken along the line A-A of FIG. 2.

FIG. 1 is a diagram showing the whole configuration of an image forming apparatus 1 of the exemplary embodiment, as viewed from the operation side. FIG. 2 is an enlarged section view of an image forming section of the image forming apparatus 1, as viewed from the back side of the apparatus. FIG. 3 is a perspective view illustrating a recovered-toner transporting mechanism 50, as viewed from the back side of the apparatus. FIG. 4 is a plan view of a toner housing portion of a developing device corresponding to a section taken along the line A-A of FIG. 2.

The image forming apparatus 1 includes: a photosensitive drum 11 which has a photosensitive layer on the surface and serves as an image carrier; a charging roll 12 which uniformly charges the photosensitive drum 11; a laser scanning device 13 which scans a laser beam over the charged photosensitive drum 11 to form an electrostatic latent image; the developing device 20 which allows a toner to adhere to the electrostatic latent image to form the image as a toner image; a transfer roll 14 which transfers the toner image formed on the photosensitive drum 11 onto a recording sheet P serving as a recording medium; and a cleaning device 30 which removes a toner that remains on the photosensitive drum 11 after the transfer. The apparatus further includes: the detachable toner housing portion (toner cartridge) 15 which supplies the toner to the developing device 20; a recording sheet transporting mechanism 40 which transports the recording sheet P housed in a sheet tray 41; and a fixing device 16 which fixes the toner image on the recording sheet P.

The developing device 20 is a developing device of the two-component developing system that uses a developer in which the toner and a carrier are mixed together. The toner is consumed in accordance with the image formation, and is replenished from the toner housing portion 15 through a toner supply path 15A. A toner transport auger 15B is disposed in the toner supply path 15A.

The cleaning device 30 is connected to the developing device 20 by the recovered-toner transporting mechanism 50, whereby the apparatus is configured so that a toner (recovered toner) which is removed and recovered from the photosensitive drum 11 by the cleaning device 30 is returned to the developing device 20 to be reused. The developing device 20, the cleaning device 30, and the recovered-toner transporting mechanism 50 which connects therebetween will be described later in detail.

The image forming apparatus 1 operates in the following manner to form an image on a recording sheet.

First, an electrostatic latent image corresponding to an image is written by the laser scanning device 13 on the surface of the photosensitive drum 11 which is rotated at a predetermined rotational speed and charged to a predetermined potential by the charging roll 12. Next, the electrostatic latent image is developed (formed as a toner image) by the developing device 20. At a transferring position where the transfer roll 14 is opposed to the photosensitive drum 11, the toner image is transferred by a transfer bias applied to the transfer roll 14, onto the recording sheet P which is transported by the recording sheet transporting mechanism 40 at a speed synchronized with the rotational speed of the photosensitive drum 11. Thereafter, the recording sheet P onto which the toner image has been transferred is transported to the fixing device 16 by the recording sheet transporting mechanism 40, the toner image is fixed onto the recording sheet P by the fixing device 16, and the recording sheet is then discharged to the outside of the apparatus. The cleaning device 30 removes and recovers a residual toner which remains on the photosensitive drum 11 even after the transfer of the toner image onto the recording sheet P. The recovered-toner transporting mechanism 50 returns the recovered toner to the developing device 20.

Next, the cleaning device 30, the developing device 20, and the recovered-toner transporting mechanism 50 that transports the toner recovered by the cleaning device 30 to the developing device 20 will be described in detail. In the following description, the side of the developing device 20 which is close to the photosensitive drum 11 is called the front, and the remote side is called the rear.

The cleaning device 30 is positioned in the extreme downstream side of the electrophotographic process device that is arranged in the rotation direction of the photosensitive drum 11 indicated by the arrow in FIG. 2, and includes a blade 31 and a cleaner auger 32.

The blade 31 is formed into a plate-like shape by an elastic material, for example, thermoset polyurethane rubber which has excellent mechanical properties such as wear resistance, crack resistance, and creep resistance. The tip end edge of the blade butts against the photosensitive drum 11.

The cleaner auger 32 is disposed in the upper side of the basal end portion of the blade 31, and along the longitudinal direction, and rotated by a rotation driving mechanism which is not shown, so as to transport the recovered toner which is removed by the blade 31 from the photosensitive drum 11, to the recovered-toner transporting mechanism 50 that will be described later.

The recovered-toner transporting mechanism 50 is connected to an end portion of the cleaning device 30 on the side of the toner transportation by the cleaner auger 32.

The recovered-toner transporting mechanism 50 includes: a recovered-toner transport path 51 through which the cleaning device 30 and the developing device 20 are connected together; and a toner transport lever 52 which is disposed in the path. The mechanism is configured in an end portion of the back face side (the back side in FIG. 1, and the front side in FIG. 2) of the image forming apparatus 1.

The recovered-toner transport path 51 is connected at the upper end to the cleaning device 30, and at the lower end to the upper portion of the developing device 20.

While the upper end of the toner transport lever 52 is rotatably attached to an end portion of the cleaner auger 32 so that the center is shifted from the rotation center of the cleaner auger 32, the toner transport lever is disposed inside the recovered-toner transport path 51. The toner transport lever moves vertically inside the recovered-toner transport path 51 by rotation of the cleaner auger 32, to function so as to transport the toner.

The mechanism which transports the toner recovered by the cleaning device 30 to the developing device 20 (in the present exemplary embodiment, the recovered-toner transport path 51 and the toner transport lever 52) is not restricted to this configuration. For example, the mechanism may have a configuration in which a toner is transported using a spiral blade (auger), a spiral member (coil), or the like.

In the developing device 20, a development housing 21 which accommodates the developer includes: a developing roll 22; two screw augers 25 (a front auger 25F and a rear auger 25R); and a trimmer 23.

The developer is circulated to be agitated in the development housing 21 by the two screw augers 25 to cause the toner and the carrier to rub against each other, whereby the toner is charged and attracted to the developing roll 22. The developing roll 22 transports the attracted toner by rotation of a development sleeve to a developing area which is opposed to the photosensitive drum 11. In the exemplary embodiment, namely, the two screw augers 25 are a rotation transporting mechanism, and constitute a toner transporting section.

The trimmer 23 regulates the thickness of the toner layer to a predetermined thickness.

The development housing 21 is opened in the side which is opposed to the photosensitive drum 11, and the developing roll 22 is disposed in the opening. The screw augers 25 (the front auger 25F and the rear auger 25R) are disposed inside the development housing 21. The trimmer 23 is disposed above the developing roll 22.

The upper face of the development housing 21 is closed by an upper cover 24. In an end portion on the back side of the apparatus, a recovered toner supply port 24A and a fresh-toner supply port 24B are opened anteroposteriorly adjacently. The recovered-toner transporting mechanism 50 (the recovered-toner transport path 51) is connected to the recovered toner supply port 24A. The toner supply path 15A elongating from the toner housing portion 15 is connected to the fresh-toner supply port 24B.

Although not illustrated in detail, the developing roll 22 is configured by: the development sleeve that is rotatably disposed and to which a development bias power source is connected; and a magnet roll which is fixed to the inner side of the development sleeve in which plural magnetic poles are arranged.

The development housing 21 has a length which is sufficient to cover the whole area in the longitudinal direction of the photosensitive drum 11. The interior of the housing is partitioned by a partition wall 21A which is erected at a predetermined height from the bottom plate, into two antero-posterior spaces (a front space 21F which is close to the photosensitive drum 11, and a rear space 21R which is remote from the photosensitive drum 11). In the interiors of the front and rear spaces 21F and 21R, the screw augers 25 (the front auger 25F and the rear auger 25R respectively) are disposed in parallel with the developing roll 22.

Communicating portions 21Aa, 21Ab in which the partition wall 21A is not erected in a predetermined range are formed respectively in both end portions of the development housing 21 in the longitudinal direction (the direction which is parallel to the axial direction of the photosensitive drum 11). The front and rear spaces 21F and 21R communicate with each other through the communicating portions 21Aa, 21Ab.

The screw augers 25 (the front auger 25F and the rear auger 25R) which are disposed inside the development housing 21 are rotated by driving sections such as an electric motor which is not shown. In the exemplary embodiment, the screw augers 25 (the front auger 25F and the rear auger 25R) are rotated in a clockwise direction in FIGS. 2 and 6.

In each of the screw augers 25, a blade 25*b* is spirally formed around a shaft 25*a*. When the screw auger is rotated, a surrounding toner is transported by the blade 25*b*.

The rotation directions of the screw augers 25, and the spiral directions of the flights 25*b* are set so that the developer in the development housing 21 is transported as indicated by the arrows in FIG. 4. Namely, the front auger 25F which is close to the developing roll 22 is set so as to transport the developer in the front space 21F from the right side in the figure to the left side, and the rear auger 25R is set so as to transport the developer in the rear space 21R from the left side to the right side. The front and rear spaces 21F and 21R communicate with each other through the communicating portions 21Aa, 21Ab at the end portions. The developer is moved from the front space 21F to the rear space 21R, and from the rear space 21R to the front space 21F through the communicating portions 21Aa, 21Ab. Therefore, the developer circulates in the development housing 21 in a clockwise direction in FIG. 4.

In this way, the developer is circulated in the development housing 21 by the two screw augers 25, whereby the developer is agitated and the toner is charged by friction with the carrier.

The recovered toner supply port 24A to which the recovered-toner transporting mechanism 50 (the recovered-toner transport path 51) is connected is set in the extreme downstream side of the movement direction of the developer in the front space 21F (the upper side of the end portion of the extreme downstream side of the front auger 25F). The fresh-toner supply port 24B to which the toner supply path 15A is connected is set in the extreme upstream side of the movement direction of the developer in the rear space 21R (the upper side of the end portion of the extreme upstream side of the rear auger 25R).

In a portion of the front auger 25F corresponding to the recovered toner supply port 24A, a blade which is opposite in spiral direction is formed. According to this configuration, the recovered toner supplied from the recovered-toner transport path 51 is transported in a direction which is opposite to the circulation direction of the developer in the front space 21F. Therefore, the recovered toner supplied from the recovered-toner transport path 51 joins the circulated developer in front of the communicating portion 21Aa.

A foreign-material capturing and removing mechanism 60 is disposed in the communicating portion 21Aa through which the developer is moved from the front space 21F to the rear space 21R.

Figure 5:
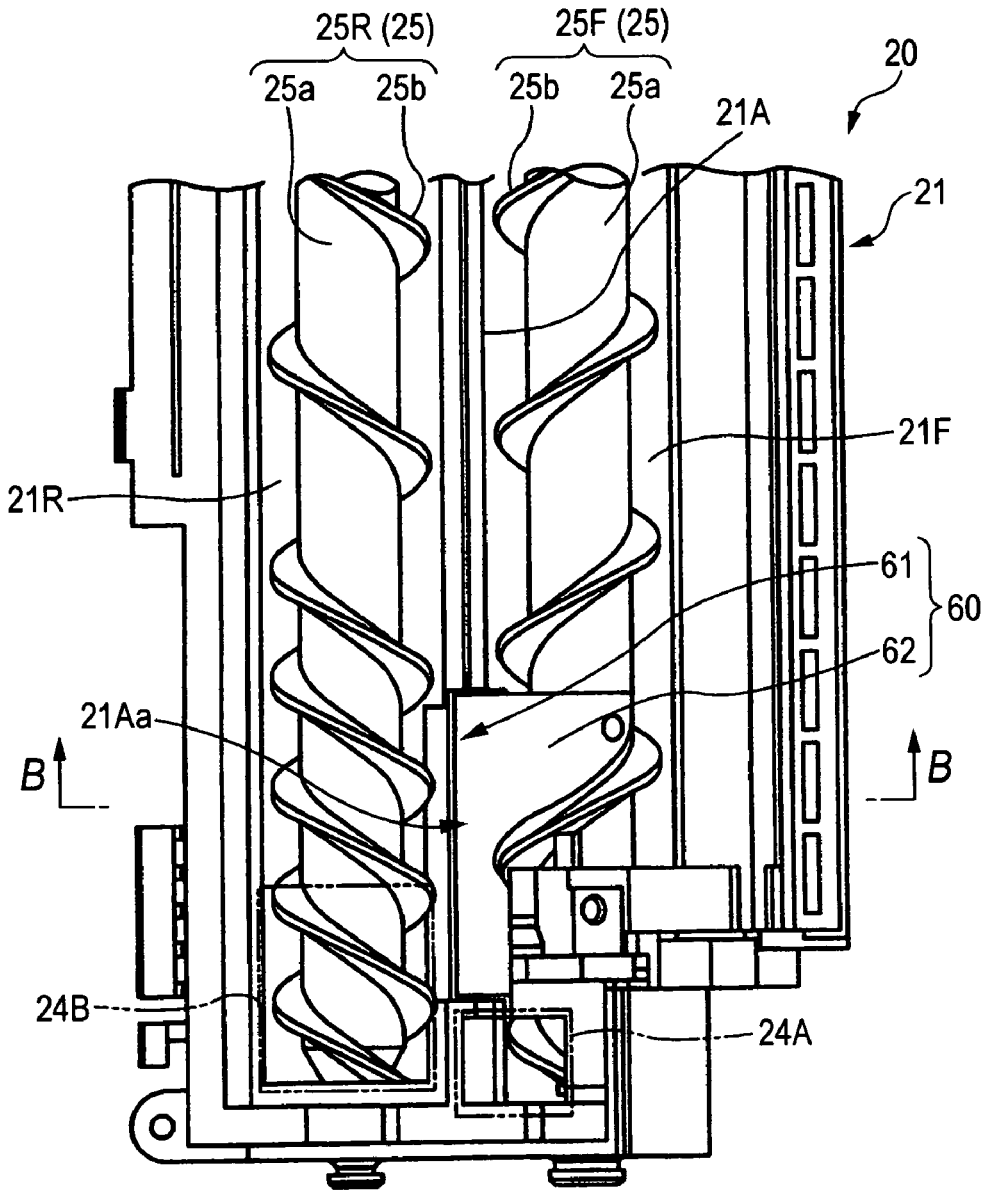
FIG. 5 is a partial enlarged plan view of a portion where a foreign-material capturing and removing mechanism is disposed, and corresponding to an enlarged view of the portion X of FIG. 4.
Figure 6:
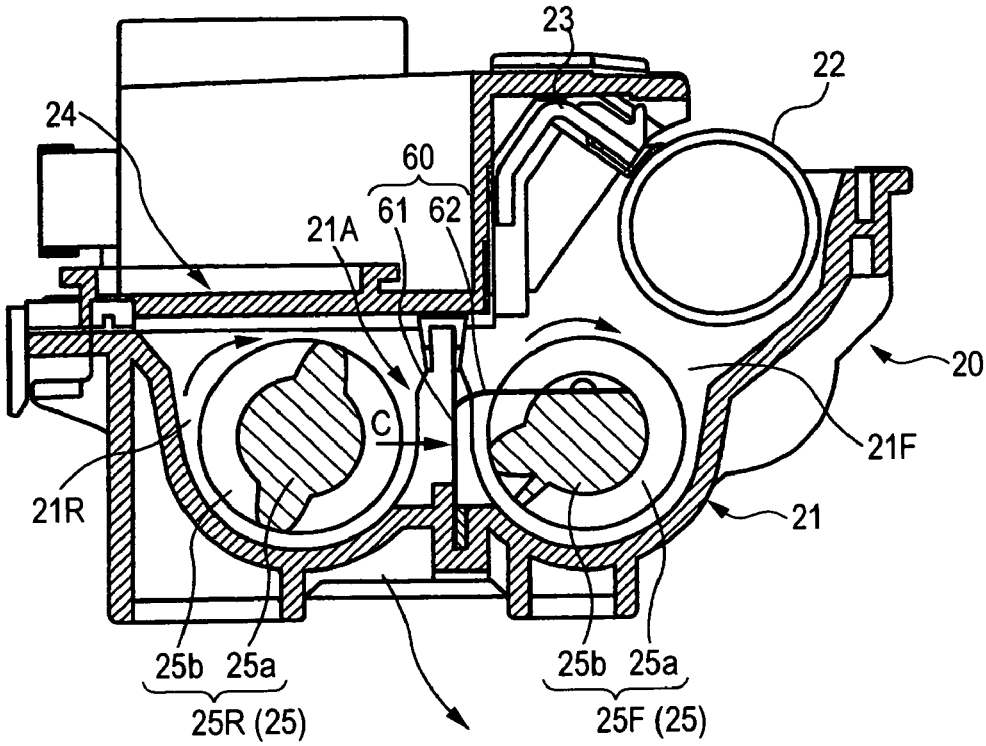
FIG. 6 is an enlarged section view of the developing device corresponding to a section taken along the line B-B of FIG. 5.

FIG. 5 is a partial enlarged plan view of a portion where the foreign-material capturing and removing mechanism 60 is disposed and corresponds to an enlarged view of the portion X of FIG. 4. FIG. 6 is an enlarged section view of the developing device 20 corresponding to a section taken along the line B-B of FIG. 5. FIG. 7A is an end view looking in the direction of the arrow C in FIG. 6. FIG. 7B is an enlarged view of the portion Y of FIG. 7A and FIG. 8 is a diagram conceptually showing the foreign-material capturing and removing mechanism 60.

The foreign-material capturing and removing mechanism 60 includes: a filter 61 serving as a filter member which is a capturing section disposed so as to close the communicating portion 21Aa; and a wiping sheet 62 which is a foreign-material removing member that wipes out the filter 61.

The filter 61 is formed by a thin plate of a rectangular shape which can close the communicating portion 21Aa. In the whole area excluding a peripheral trimming frame portion, multiple slits 61A which vertically elongated are positioned at predetermined intervals in the horizontal direction. The portions between the slits 61A form non-opening portions 61B. The non-opening portions 61B are capturing members which capture a foreign material. For example, preferably, the widths (opening widths) of the slits 61A are 0.1 to 1.5 mm, and the widths of the non-opening portions 61B are about 0.1 mm. However, these widths are set in consideration of the aperture ratio in relation to the circulated amount of the developer. The filter 61 can be formed by opening the slits 61A by etching or the like in a plate of a predetermined thickness (for example, 0.1 mm) made of stainless steel alloy or the like. The thickness of the filter is set so that the filter is so rigid that a failure such as deformation or dropout is not caused even by a wiping function of the wiping sheet 62 which will be described later.

The attachment of the filter 61 is performed by fitting the filter into an attachment groove which is formed in the periphery of the communicating portion 21Aa. The filter is fixed by an adhesive agent or the like as required, and disposed so as to close the communicating portion 21Aa. According to the configuration, the developer permeates through the filter 61 (passes through the slits 61A), so that the developer can be moved from the front space 21F to the rear space 21R. When the attachment of the filter 61 is performed only by fitting, replacement of the filter 61 is enabled even in the case where the life period of the filter 61 is different from that of the developing device 20.

The material and forming method of the filter 61 are not restricted to those of the above-described configuration, and may be adequately modified. For example, the filter may be configured by stretching a resin line such as a nylon string or a metal wire on a metal frame. Alternatively, the filter 61 may not be integrally formed, and may be configured by juxtaposing plural rod-like members serving as capturing sections at predetermined intervals. Furthermore, the attachment structure may be adequately modified, and may be configured by adhesion to a face of the partition wall 21A.

The wiping sheet 62 is a thin plate which has predetermined elasticity so as to be deformable. The plan shape of the sheet is formed into a rectangular shape having a width corresponding to the filter 61. The wiping sheet is formed by a sheet of a resin such as PET. One edge of the sheet is fixed to the shaft 25*a* of the front auger 25F by thermal welding or the like. The disposition position and length of the sheet are set so that, as shown in FIG. 8, a tip end portion of the sheet is caused to interfere with the filter 61 by rotation of the front auger 25F to wipe the filter 61 in the direction from the lower side to the upper side. Namely, the tip end of the wiping sheet 62 is caused by the rotation to contact with a substantially lower end portion of the filter 61, the degree of interference is gradually increased in accordance with the rotation to be largest at a substantially middle in the height direction of the filter 61, and the tip end reaches an upper end portion of the filter 61 while the degree of interference is gradually reduced.

The wiping sheet 62 may be set so that the sheet separates from the filter 61 while an area (non-wiping area) with which the wiping sheet does not interfere is left in the upper end portion of the filter. In this case, the non-interference area is set so as to be positioned above the surface level (indicated by the one-dot chain line in the figure) of the developer which circulates in the development housing 21. The rotation axis of the wiping sheet 62 (i.e., that of the front auger 25F) horizontally elongates, and is perpendicular to the slits 61A of the filter 61, and therefore the wiping sheet 62 is moved in parallel with the elongating direction of the slits 61A.

In the thus configured foreign-material capturing and removing mechanism 60, the filter 61 captures a foreign material such as paper dust entering the developer which circulates inside the development housing 21, and the wiping sheet 62 holds the foreign material captured by the filter 61 to the upper side of the filter 61.

In the filter 61 which is disposed in the communicating portion 21Aa, when the developer passes through the slits 61A, namely, the non-opening portions 61B catch a foreign material entering the developer by the non-opening portions 61B between the slits 61A to capture the foreign material. The wiping sheet 62 wipes the filter 61 in the elongating direction of the slits 61A, whereby the foreign material captured by the filter 61 is upward moved along the slits 61A (the non-opening portions 61B) to be held to the upper side. This prevents the passing of the developer through the slits 61A from being impeded. In the above-described configuration where the non-interference area with which the wiping sheet 62 does not interfere is disposed in the upper edge portion of the filter 61, the foreign material moved by the wiping sheet 62 stagnates in the non-interference area. The wiping sheet 62 does not butt against the foreign material stagnating in the non-interference area, and therefore the foreign material can be prevented from dropping from the non-interference area. Since the non-interference area is positioned above the surface level of the developer, the foreign material can stagnate outside the passing area of the developer through the slits 61A, and hence the passing of the developer through the slits 61A is not impeded.

As described above, the foreign-material capturing and removing mechanism 60 is disposed in the communicating portion 21Aa immediately downstream from the portion (the recovered toner supply port 24A) to which the recovered toner is supplied by the recovered-toner transporting mechanism 50. Therefore, the recovered toner passes through the foreign-material capturing and removing mechanism 60 immediately after it joins the circulated developer. Consequently, a foreign material such as paper dust entering the recovered toner can be efficiently captured and removed by the foreign-material capturing and removing mechanism 60.

Engagement projections serving as holding sections for engaging with a foreign material to capture it may be disposed in the upper edge portion of the filter 61 in which a foreign material is collected by the wiping sheet 62.

Figure 7:
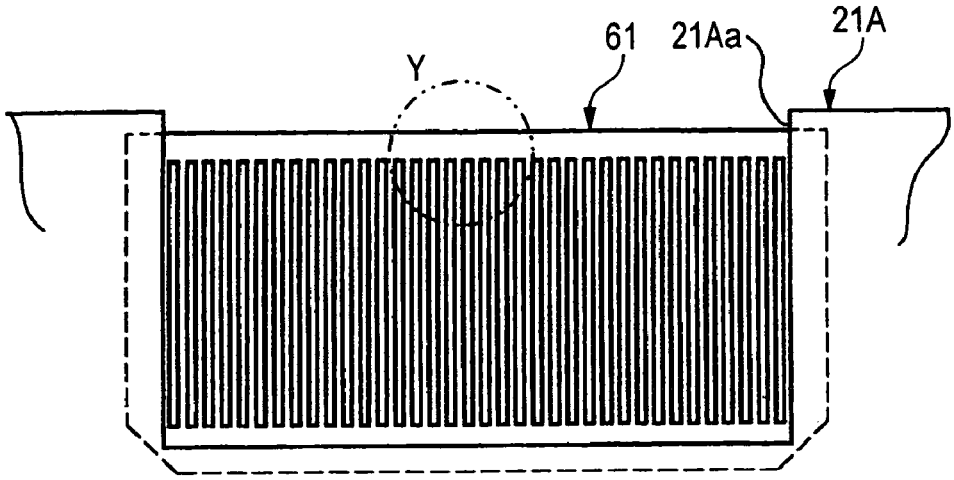
FIG. 7 is an end view looking in the direction of the arrow C in FIG. 6.
Figure 7:
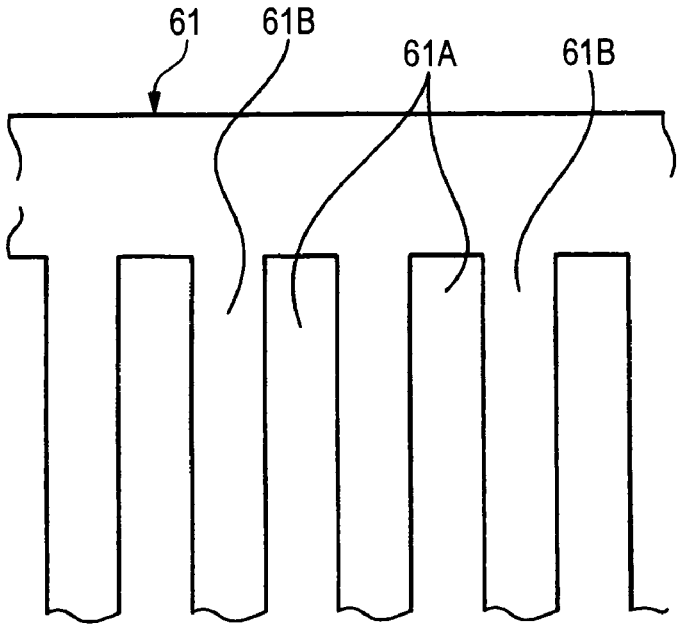
Figure 8:
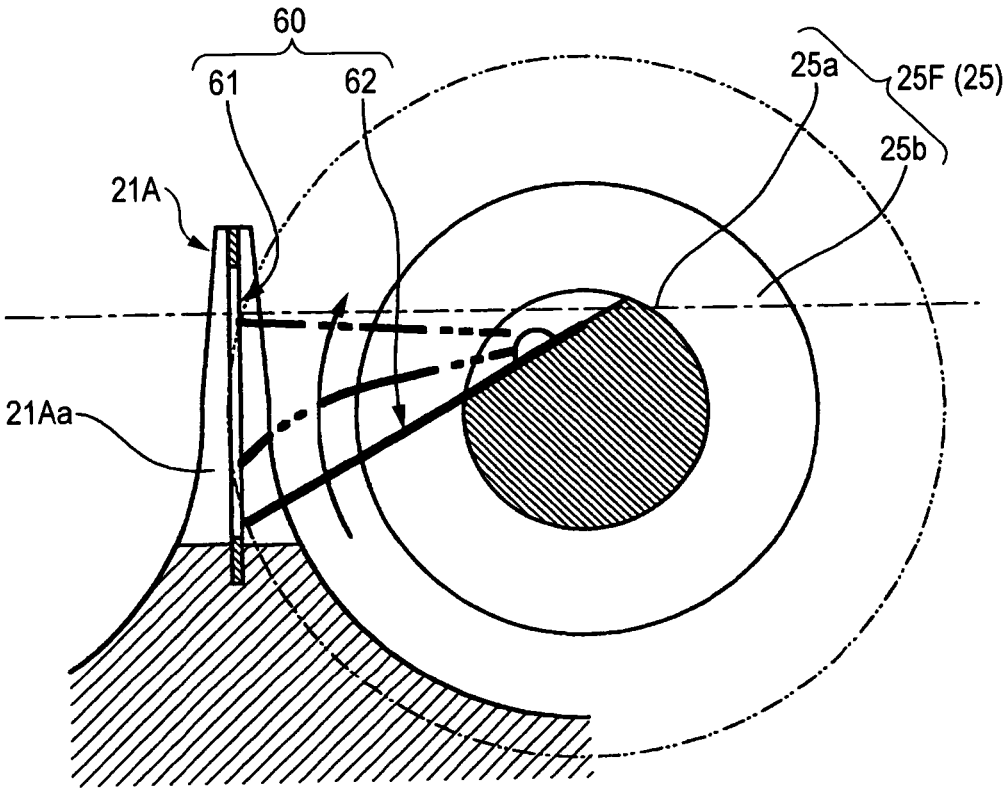
FIG. 8 is a diagram conceptually showing the foreign-material capturing and removing mechanism.
Figure 9:
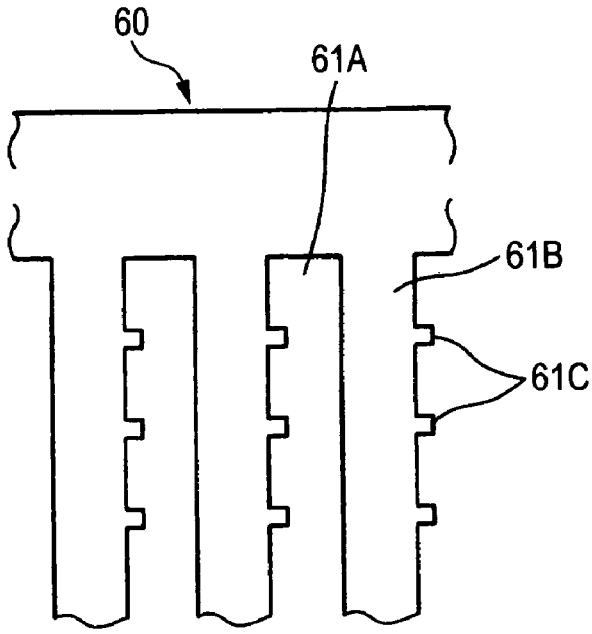
FIG. 9 is a view showing an example of engagement projections corresponding to an enlarged view of the portion Y of FIG. 7.
Figure 9:
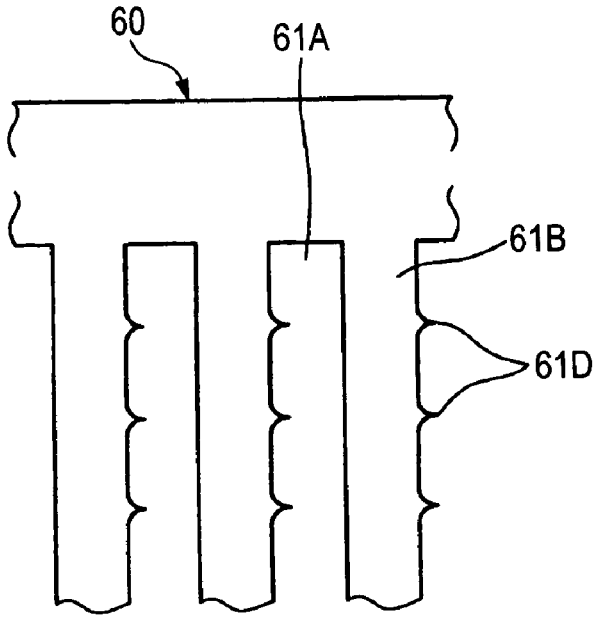

FIG. 9 shows an example of such engagement projections and corresponds to an enlarged view of the portion Y of FIG. 7.

FIG. 9A shows a configuration where rectangle engagement projections 61C are formed on the non-opening portions 61B between the slits 61A so as to be projected toward the slits 61A. FIG. 9B shows a configuration where engagement projections 61D having a pointed tip end and a substantially triangular shape are formed on the non-opening portions 61B between the slits 61A so as to be projected toward the slits 61A.

When the engagement projections 61C or 61D serving as a holding structure are disposed, the engagement projections 61C or 61D engage with a foreign material which is collected to their formation portions by the wiping sheet 62, whereby the effect of holding a foreign material is enhanced and the foreign material can be prevented from dropping off. As a result, a foreign material which has been once captured by the foreign-material capturing and removing mechanism 60 can be prevented from again entering the developer.

A configuration where the slits 61A hold a collected foreign material may be employed.

Figure 10:
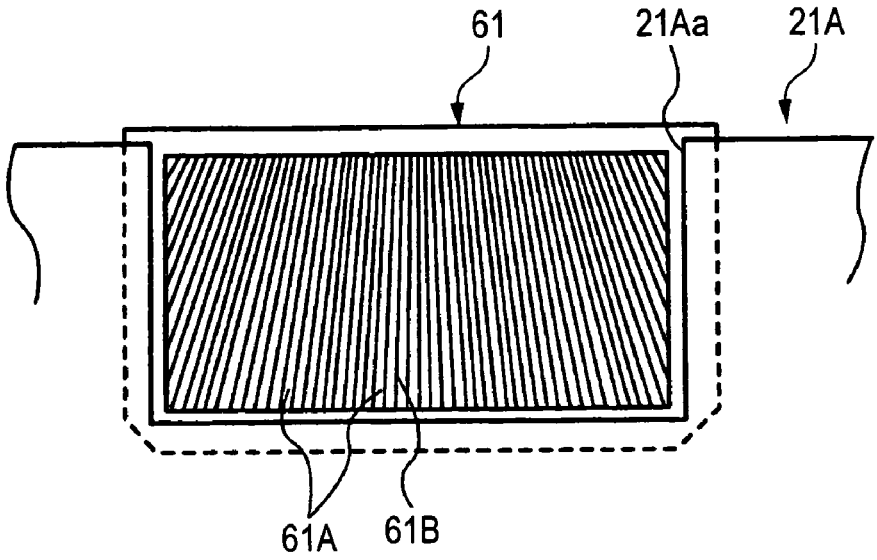
FIG. 10 is a front view of a configuration example in which a foreign material is held by a slit.

FIG. 10 is a front view of the filter 61 to which an example of the configuration is applied.

In the filter 61 shown in FIG. 10, the slits 61A are formed so that the width is gradually narrowed as advancing from the lower side toward the upper side. According to the configuration, a foreign material which has been collected to the upper portion of the filter 61 by the wiping sheet 62 is squeezed into the narrowed slits 61A to be held in a non-droppable manner. Also in this configuration, a foreign material which has been once captured can be prevented from again entering the developer.

Furthermore, a housing section for housing a foreign material may be disposed in an upper edge portion of the filter 61.

Figure 11:
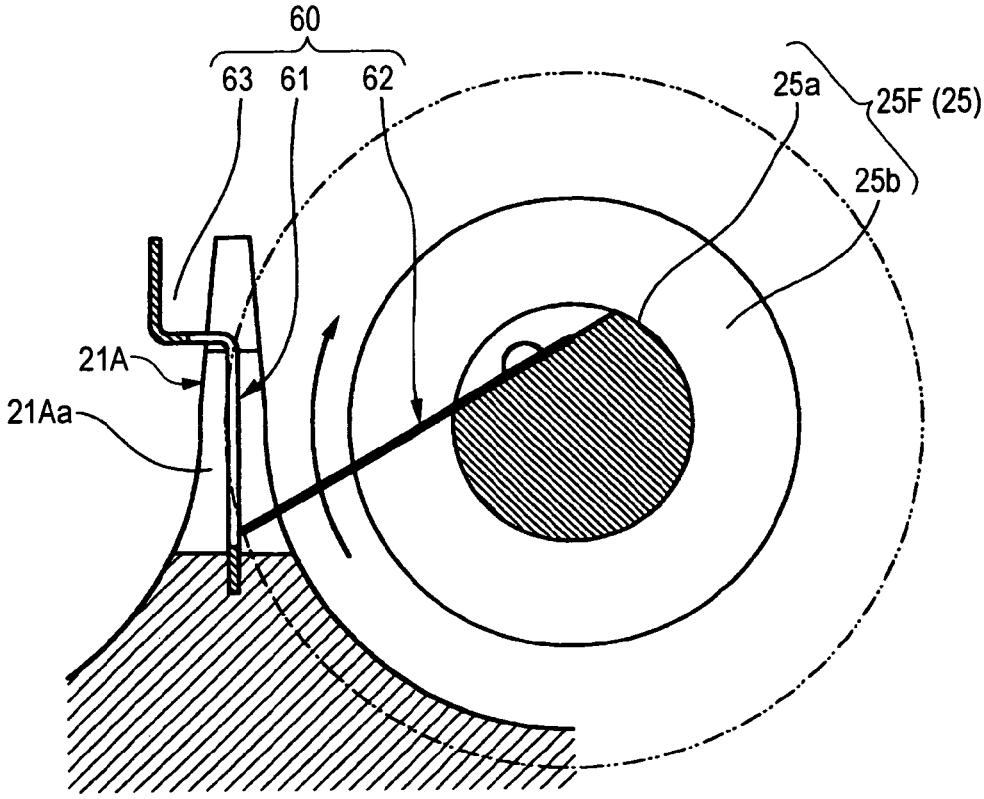
FIG. 11 shows a filter in which a housing portion is formed in an upper edge portion.
Figure 11:
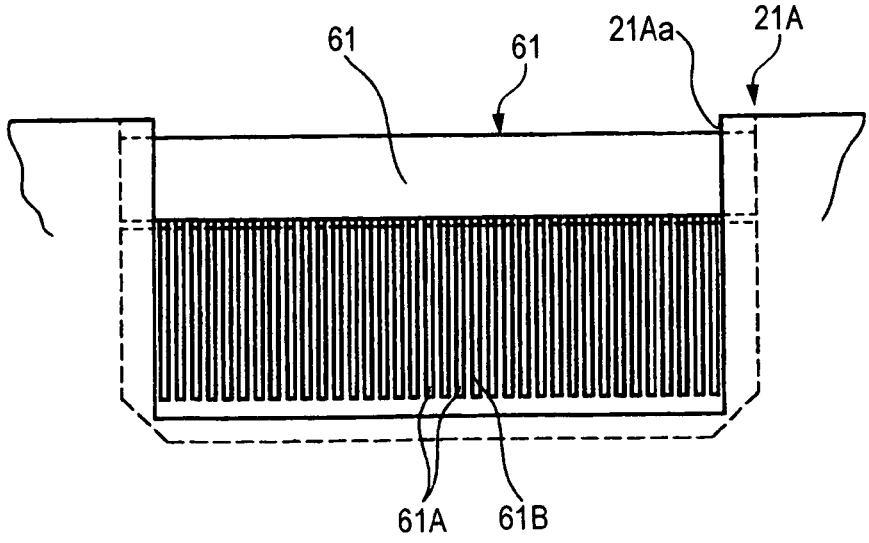
Figure 12:
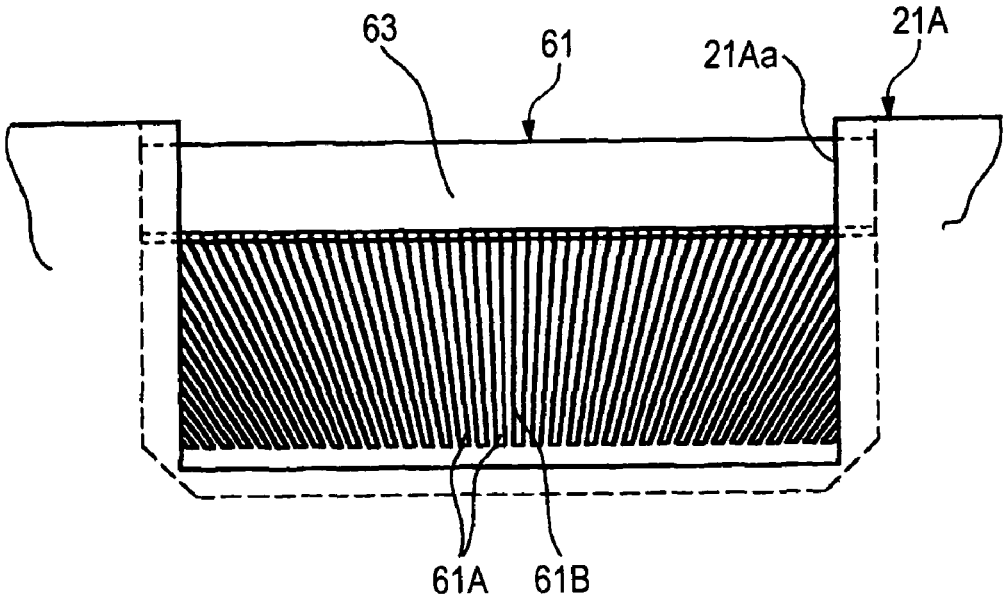
FIG. 12 is a front view of a filter having slits of a different shape.

FIG. 11 shows the filter 61 in which a housing portion 63 serving as a foreign-material accumulating section that is an example of the housing section is formed in the upper edge portion. FIG. 11A is a section view, and FIG. 11B is a front view. FIG. 12 is a front view of the filter 61 having the slits 61A of a different shape.

In the filter 61 shown in FIG. 11, as shown in FIG. 11A, the upper edge portion in a section view is bent into a crank-like shape toward the downstream side to form the housing portion 63. The slits 61A are opened in the direction toward the housing portion 63. According to the configuration, a foreign material which is collected to the upper portion of the filter 61 by the wiping sheet 62 can be housed in the housing portion 63.

The filter 61 shown in FIG. 12 has the configuration in which the housing portion 63 is disposed in the upper portion, and in addition is formed so that the widths of the slits 61A are gradually increased towards the upper side. According to the configuration, a foreign material can be easily housed in the housing portion 63.

In the wiping sheet 62, alternatively, the shape of the tip edge which wipes the filter 61 may be formed so as to correspond to the slits 61A of the filter 61.

Figure 13:
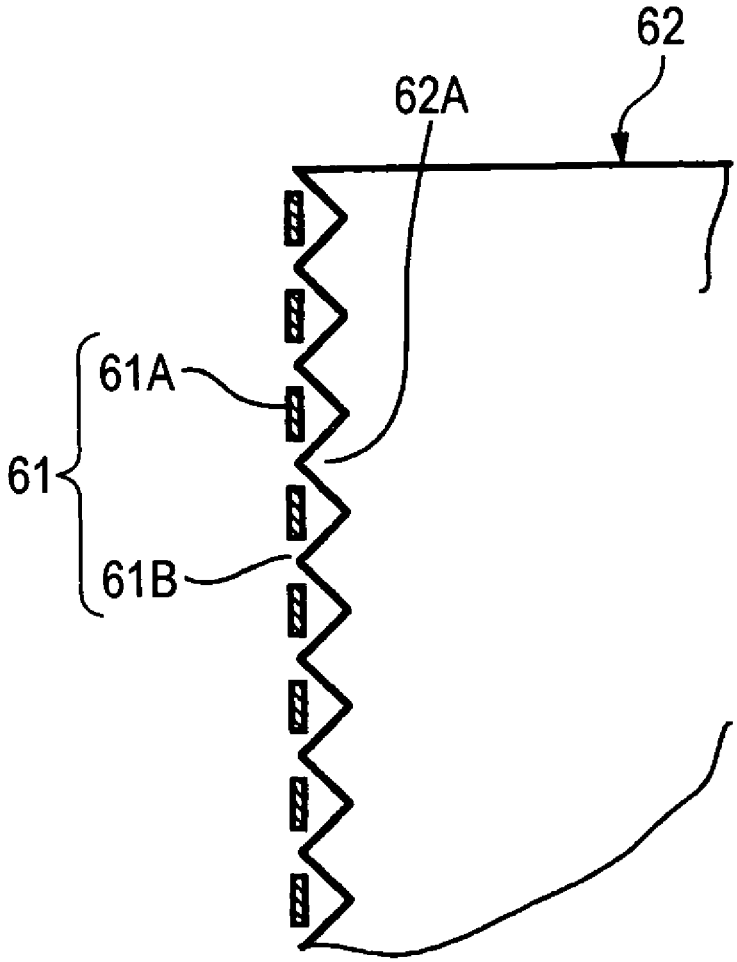
FIG. 13 is an enlarged view showing an example of the shape of the tip edge of a wiping sheet.

FIG. 13 is an enlarged view of the tip edge of the wiping sheet 62 in an example of this alternative.

In the wiping sheet 62 shown in FIG. 13, triangular convex portions 62A are formed in the tip edge at pitches corresponding to those of the slits 61A of the filter 61. When the wiping sheet 62 is formed in this way, it is possible to more efficiently collect a foreign material which has been captured by the filter 61.

The exemplary embodiment described above is configured so that the wiping sheet 62 wipes the filter 61 in the direction from the lower side to the upper side to collect a foreign material toward the upper side. The wiping direction is not restricted to this.

Figure 14:
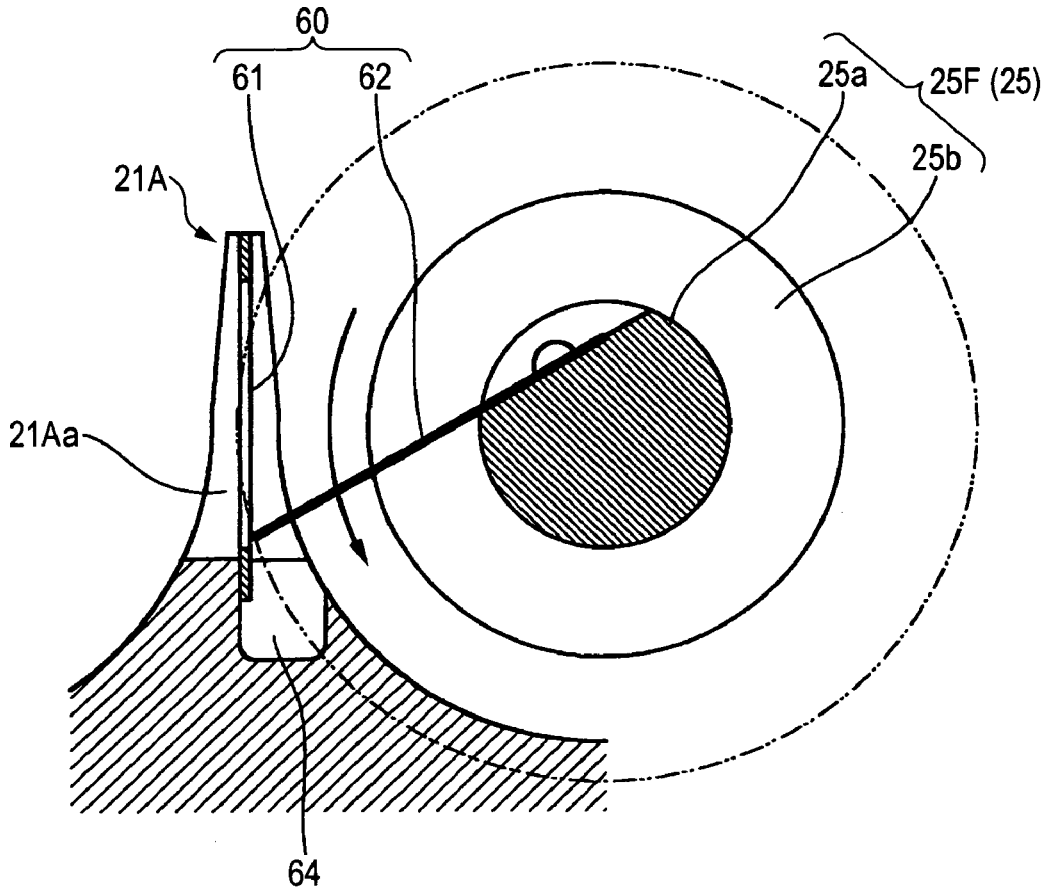
FIG. 14 is a section view of a foreign-material capturing and removing mechanism in which the wiping sheet has another wiping direction.

FIG. 14 is a section view of an example of a configuration of another wiping direction.

In the configuration shown in FIG. 14, the wiping sheet 62 wipes the filter 61 in the direction from the upper side to the lower side to collect a foreign material toward the lower side. In this case, the rotation direction of the front auger 25F to which the wiping sheet 62 is attached is opposite to that of the above-described embodiment. When the spiral direction of the flight is inverted, however, the transportation and movement direction of the developer can be unchanged.

In a portion of the lower side of the filter 61 into which a foreign material is collected, and which is opposed to the wiping sheet 62, the development housing 21 is recessed to form a foreign-material housing portion 64 serving as the foreign-material accumulating section that is an example of the housing section.

In this configuration, a foreign material which is captured by the filter 61 and collected by the wiping sheet 62 is housed in the foreign-material housing portion 64.

The developing device 20 in the exemplary embodiment is configured so that the recovered toner from the recovered-toner transporting mechanism 50, and a replenished toner from the toner supply path 15A are supplied to different portions of the development housing 21, respectively. Alternatively, a configuration where the supply paths for the recovered and replenished toners are joined together and the recovered and replenished toners are supplied to the development housing 21 through the identical path may be employed.

Figure 15:
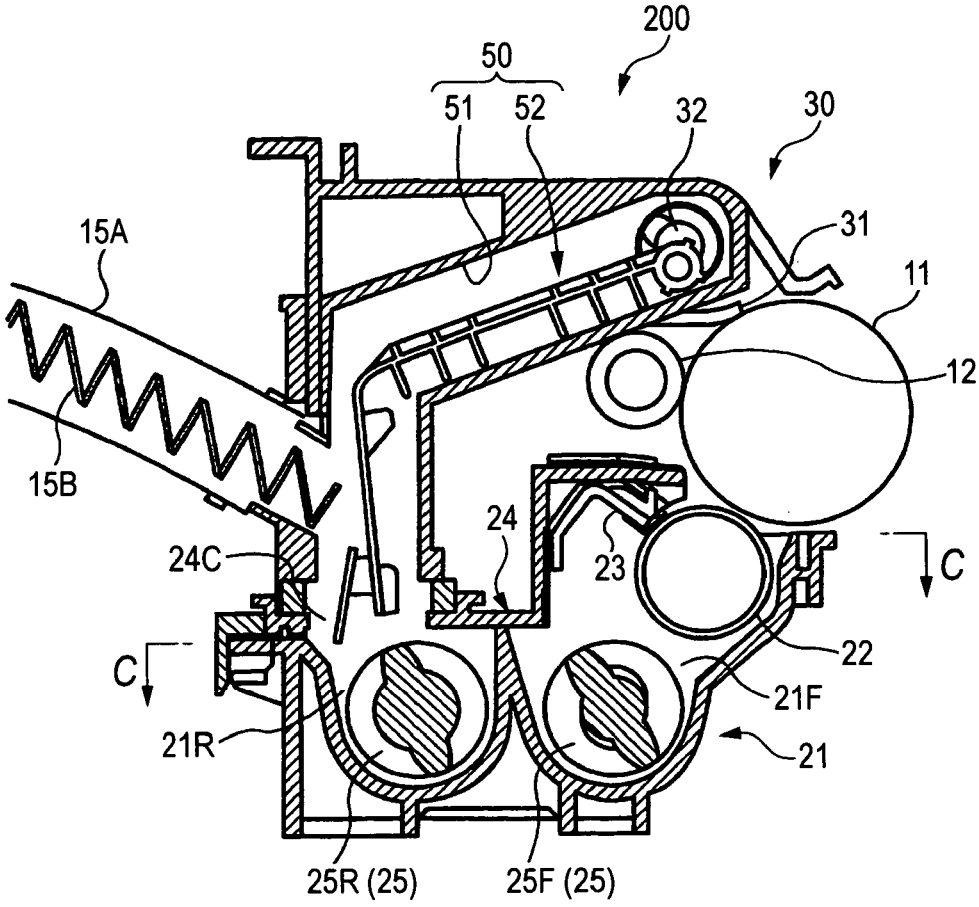
FIG. 15 is a section view of the developing device having a different configuration.
Figure 16:
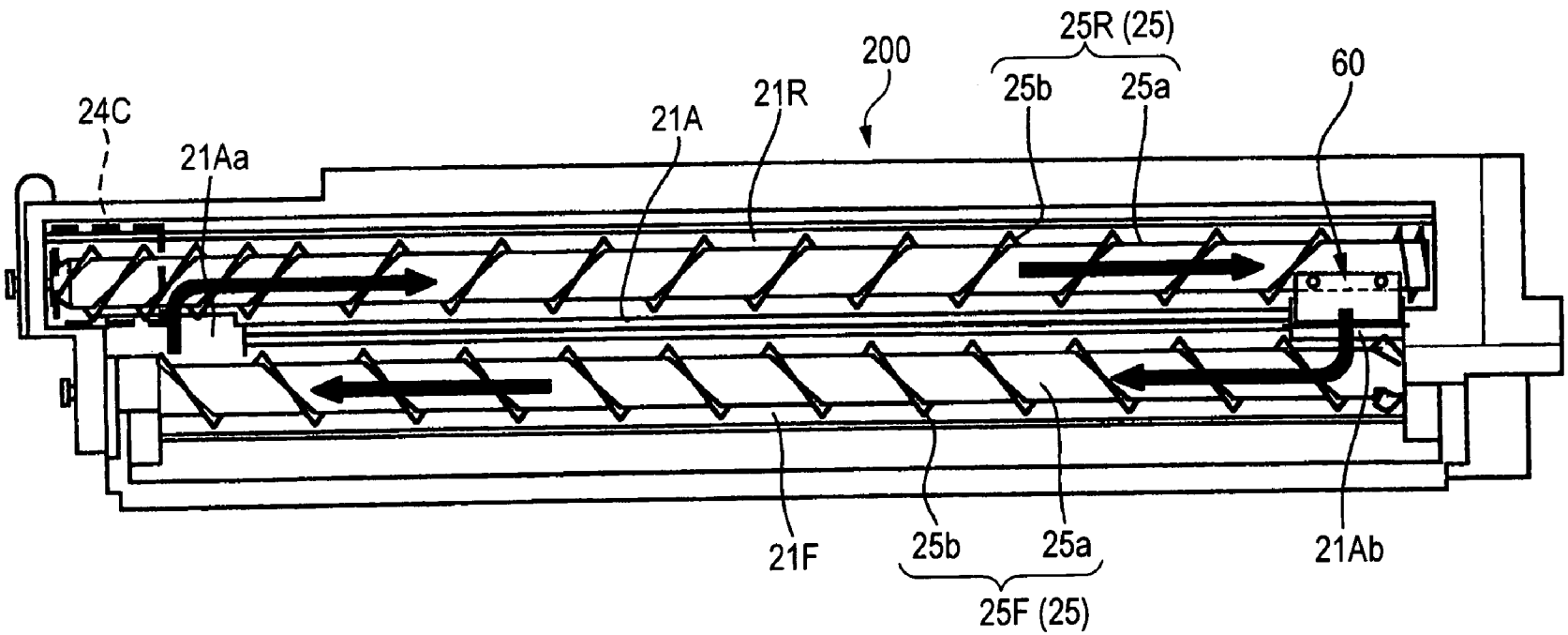
FIG. 16 is a plan view of a development housing corresponding to a section view taken along the line C-C of FIG. 15.

FIG. 15 is a section view of a developing device 200 having such a configuration, and FIG. 16 is a plan view of the development housing 21 corresponding to a section view taken along the line C-C of FIG. 15. In the figures, the components which are identical in function with those of the above-described exemplary embodiment are denoted by the same reference numerals, and their description is omitted.

In the configuration shown in FIG. 15, a recovered-toner transport path 51A of the recovered-toner transporting mechanism 50, and the toner supply path 15A are joined together to be formed as a single path which is connected to the extreme upstream portion (a connection port 24C) of the rear space 21R.

The foreign-material capturing and removing mechanism 60 is disposed in the communicating portion 21Ab through which the developer is moved from the rear space 21R to the front space 21F.

According to the configuration, the recovered and replenished toners are supplied to the development housing 21 through the same path. When the developer is moved from the rear space 21R to the front space 21F, therefore, a foreign material is captured and removed by the foreign-material capturing and removing mechanism 60. As a result, a foreign material which has entered the recovered toner can be prevented from entering the front space 21F where the toner is adhered to the developing roll 22.

The invention is not restricted to the above-described embodiment, and may be adequately modified.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a cleaning device that recovers a toner that remains on the image carrier;

a recovered toner supply port to which a recovered toner is returned;

a toner transporting section that transports the toner supplied from the recovered toner supply port, within the developing device;

a capturing section including a plurality of capturing members formed on a path along which the toner is transported by the toner transporting section, and capturing a foreign material;

a foreign-material removal member that moves along an elongating direction of the plurality of capturing members, and removes the foreign material captured by the plurality of capturing members;

a foreign-material accumulating section that collects the foreign material, disposed in front of a direction along which the foreign-material removal member moves and handles the foreign material; and a plurality of projections that engage with and hold the foreign material disposed on an upstream side of the capturing section in a direction along which the foreign-material removal member moves and handles the foreign material.

2. An image forming apparatus comprising:

an image carrier;

a developing device that forms a toner image on the image carrier;

a cleaning device that removes and recovers a toner remaining on the image carrier; and a recovered toner transporting section that transports the toner recovered by the cleaning device to the developing device, the developing device comprising:

a recovered toner supply port to which the recovered toner is supplied by the recovered toner transporting section;

a toner transporting section that transports the toner supplied from the recovered toner supply port within the developing device;

a capturing section that captures a foreign material and includes a plurality of capturing members formed on a path along which the toner is transported by the toner transporting section;

a foreign-material removal member that moves along an elongating direction of the plurality of capturing members, and removes the foreign material captured by the plurality of capturing members;

a foreign-material accumulating section that collects the foreign material, disposed in front of a direction along which the foreign-material removal member moves and handles the foreign material; and a plurality of projections that engage with and hold the foreign material disposed on an upstream side of the capturing section in a direction along which the foreign-material removal member moves and handles the foreign material.

3. A developing device, comprising:

a cleaning device that recovers a toner that remains on the image carrier;

a recovered toner supply port to which a recovered toner is returned;

a toner transporting section that transports the toner supplied from the recovered toner supply port, within the developing device;

a capturing section including a plurality of capturing members formed on a path along which the toner is transported by the toner transporting section, and capturing a foreign material; and a foreign-material removal member that moves along an elongating direction of the plurality of capturing members, and removes the foreign material captured by the plurality of capturing members;

wherein the capturing section is formed so that intervals between each of the plurality of capturing members are different towards a front-side of the moving and handling direction of the foreign-material removal member.

4. The developing device according to claim 3, wherein the toner transporting section includes a rotation transporting mechanism that rotates to transport the toner, and the foreign-material removal member is driven by the rotation transporting mechanism to move the foreign material.

5. The developing device according to claim 4, wherein a part of the foreign-material removal member is fixed to the rotation transporting mechanism.

6. The developing device according to claim 3, wherein the capturing section is disposed on a downstream side of the recovered toner supply port in a direction of toner transport, and the foreign-material removal member is disposed on an upstream side of the capturing section in the direction of toner transport.

7. The developing device according to claim 3, wherein the capturing section is a filter member formed with slits.

8. The developing device according to claim 7, wherein the filter member is replaceable.

9. The developing device according to claim 3, wherein the capturing section is a rod-like member.

10. The developing device according to claim 3, wherein the foreign-material removal member includes a wiping sheet that wipes the filter member in the elongating direction.

11. The developing device according to claim 3, wherein the capturing section is formed so that intervals between each of the plurality of capturing members gradually increase towards a front-side of the moving and handling direction of the foreign-material removal member.

12. The developing device according to claim 3, wherein the capturing section is formed so that intervals between each of the plurality of capturing members gradually decrease towards a front-side of the moving and handling direction of the foreign-material removal member.

13. An image forming apparatus comprising:

an image carrier;

a developing device that forms a toner image on the image carrier;

a cleaning device that removes and recovers a toner remaining on the image carrier; and a recovered toner transporting section that transports the toner recovered by the cleaning device to the developing device, the developing device comprising:

a recovered toner supply port to which the recovered toner is supplied by the recovered toner transporting section;

a toner transporting section that transports the toner supplied from the recovered toner supply port within the developing device;

a capturing section that captures a foreign material and includes a plurality of capturing members formed on a path along which the toner is transported by the toner transporting section; and a foreign-material removal member that moves along an elongating direction of the plurality of capturing members, and removes the foreign material captured by the plurality of capturing members, wherein the capturing section is formed so that intervals between each of the plurality of capturing members are different towards a front-side of the moving and handling direction of the foreign-material removal member.

14. The image forming apparatus according to claim 13, wherein the capturing section is a filter member formed with slits.

15. The image forming apparatus according to claim 14, wherein the filter member is replaceable.

16. The image forming apparatus according to claim 13, wherein the foreign-material removal member includes a wiping sheet that wipes the filter member in the elongating direction.

17. The image forming apparatus according to claim 13, wherein the capturing section is a rod-like member.

18. The image forming apparatus according to claim 13, wherein the capturing section is formed so that intervals between each of the plurality of capturing members gradually increase towards a front-side of the moving and handling direction of the foreign-material removal member.

19. The image forming apparatus according to claim 13, wherein the capturing section is formed so that intervals between each of the plurality of capturing members gradually decrease towards a front-side of the moving and handling direction of the foreign-material removal member.

20. The image forming apparatus according to claim 13, wherein the toner transporting section includes a rotation transporting mechanism that rotates to transport the toner, a part of the foreign-material removal member is fixed to the rotation transporting mechanism, and the foreign-material removal member is driven by the rotation transporting mechanism to move the foreign material.

21. A developing device that forms a toner image on an image carrier, comprising:

a developer container that holds a developer comprising a toner;

a cleaning device that recovers the toner that remains on the image carrier;

a recovered toner supply port to which a recovered toner is returned;

a partition member that partitions an interior of the developer container into a primary chamber and a secondary chamber;

a developer-conveying section that is disposed in the primary chamber and rotates so as to convey the developer;

a migration opening through which the developer held in the primary chamber is migratable to the secondary chamber;

a capturing section including a plurality of capturing members, each of the plurality of capturing members that is disposed at the migration opening and captures a foreign material which migrates through the migration opening together with the developer; and a foreign-material removal member that moves along an elongating direction of the plurality of capturing members, and removes the foreign material captured by the plurality of capturing members, wherein the capturing section is formed so that intervals between each of the plurality of capturing members are different towards a front-side of the moving and handling direction of the foreign-material removal member.

* * * * *